US006918246B2

(12) United States Patent
Fukumoto et al.

(10) Patent No.: US 6,918,246 B2
(45) Date of Patent: Jul. 19, 2005

(54) STRUCTURE OF AN EXHAUST MANIFOLD BRANCH COLLECTING PORTION

(75) Inventors: Yasuhiko Fukumoto, Hiroshima (JP); Katsumi Tateiwa, Hiroshima (JP); Takashi Yasuda, Hiroshima (JP); Kazuya Tominaga, Hiroshima (JP); Hideaki Shimamoto, Hiroshima (JP); Hideaki Madono, Tokyo (JP); Syuuichi Ishiwa, Tokyo (JP)

(73) Assignees: Yumex Corporation, Hiroshima (JP); Nichias Corporation, Tokyo (JP)

( * ) Notice: Subject to any disclaimer, the term of this patent is extended or adjusted under 35 U.S.C. 154(b) by 0 days.

(21) Appl. No.: 10/395,121

(22) Filed: Mar. 25, 2003

(65) Prior Publication Data

US 2003/0182937 A1 Oct. 2, 2003

(30) Foreign Application Priority Data

Mar. 27, 2002 (JP) ..... 2002-088312
Feb. 18, 2003 (JP) ..... 2003-039358

(51) Int. Cl.[7] ..... F01N 7/10

(52) U.S. Cl. ..... 60/323; 60/272; 60/282; 60/322

(58) Field of Search ..... 60/272, 282, 305, 60/322, 323

(56) References Cited

U.S. PATENT DOCUMENTS 3,444,687 A * 5/1969 Andersson ..... 60/305
5,293,743 A * 3/1994 Usleman et al. ..... 60/299
5,832,723 A * 11/1998 Iwata et al. ..... 60/276
6,155,046 A * 12/2000 Kato et al. ..... 60/323
6,360,782 B1 * 3/2002 Yoshitoshi et al. ..... 138/115
6,555,070 B1 * 4/2003 Kruger ..... 422/179

FOREIGN PATENT DOCUMENTS

JP 7-119458 5/1995
JP 410266835 A * 10/1998 ..... 60/323

* cited by examiner

*Primary Examiner*—Binh Q. Tran
(74) *Attorney, Agent, or Firm*—Armstrong, Kratz, Quintos, Hanson & Brooks, LLP.

(57) ABSTRACT

A structure of an exhaust manifold branch collecting portion includes a double collecting pipe 21 for collecting a plurality of exhaust openings 11A, 17A. The double collecting pipe 21 is comprised of an inner pipe 21-1 and an outer pipe 21-2, which are connected integrally to each other. In a space formed between the inner pipe 21-1, the outer pipe 21-2, and a ring-shaped stainless steel cushion member 22-2, a tubular cushion member 22-1, which is thermally expanded and foamed, is arranged as a restricted cushion structure.

13 Claims, 4 Drawing Sheets

STRUCTURE OF AN EXHAUST MANIFOLD BRANCH COLLECTING PORTION

FIELD OF THE INVENTION

The present invention relates to a structure of an exhaust manifold branch collecting portion, and particularly relates to countermeasures for preventing noise (exhaust noise from the exhaust manifold and vibratory noise due to contaminants, such as spatters, to be made during the production process in a space between the inner pipe and the outer pipe) or heat generation as well as for improving the durability of the exhaust manifold.

BACKGROUND OF THE INVENTION

As a conventional exhaust manifold branch collecting portion, for example, Japanese Laid-open Patent Application No. 7-119458discloses to arrange a noise/heat insulating plate provided with a nonwoven fabric, such as glass wool, around the outer periphery of the branch collecting pipe, for the purpose of isolating unusual noise derived from exhaust pulsation, that is, vibrations resulting from a flow of the exhaust gas synchronized with combustion at the engine or for the purpose of preventing as a heat insulation measure the heat quantity of the exhaust gas flowing through the pipe from being discharged to the outside. Further, the temperature of exhaust gas grows higher and higher due to regulations of exhaust gas, and the exhaust manifold branch collecting portion is liable to break because of the pulsation of the exhaust gas. For this reason, a countermeasure has been taken, such as to increase the thickness of the metal plate, by which the exhaust manifold is formed.

However, because the noise/heat insulating plate is formed by a metallic base material, a nonwoven fabric, and a wire mesh and is complicated in structure, there are drawbacks in that the production thereof is difficult and the production cost becomes higher.

In view of the above, the purpose of the present invention is to provide a structure of an exhaust manifold branch collecting portion which is easy to manufacture and which can reduce the cost, by way of preventing, with a simple structural arrangement, the occurrence of unusual noise resulting from exhaust noise that is based on vibrations of the pipe wall due to the flow of exhaust gas and the exhaust pressure and preventing the occurrence of unusual noise derived from vibrations of spatters well as improving the durability of the exhaust manifold.

SUMMARY OF THE INVENTION

According to the present invention, there is provided a structure of an exhaust manifold branch collecting portion including a collecting pipe for collecting a plurality of exhaust openings. The collecting pipe is constructed as a double collecting pipe arrangement comprised of an inner pipe and an outer pipe, and a noise absorption/heat insulating material to be expanded by heating is arranged between the inner pipe and the outer pipe.

In the aforementioned structure, the noise absorption/heat insulating material may be heated and expanded by heat of exhaust gas from an engine.

Further, in the aforementioned structure, one ends of the inner pipe and the outer pipe may be connected to each other, and a cushion part is arranged between the other ends of the inner pipe and the outer pipe.

It is preferable that the cushion part is an elastic mesh member, into which a stainless steel wire is woven.

Further, in the aforementioned structure, a heat resisting layer may be arranged between the inner pipe and/or the outer pipe and the noise absorption/heat insulating material.

The present invention provides a simple arrangement wherein a noise absorption/heat insulating material that is not expanded at the time of production is inserted between the inner pipe and the outer pipe. After assembling the exhaust manifold branch collecting portion, the noise absorption/heat insulating material absorbs heat of the exhaust gas when the engine is started.

As the result, the noise absorption/heat insulating material sealed between the inner pipe and the outer pipe of the double collecting pipe expands and forms a restricted cushion structure. Even if the collecting portion is liable to vibrate under the influence of pulsation of the exhaust gas, the restricted cushion structure prevents the vibration. Also, the noise absorption/heat insulating material arranged between the inner pipe and the outer pipe of the double collecting pipe absorbs and prevents vibratory noise and heat generation.

BRIEF DESCRIPTION OF THE DRAWINGS

Preferred embodiments of the present invention will be described below, by way of example only, with reference to the accompanying drawings, in which:

FIGS. 6A and 6B explain a structure of an exhaust manifold branch collecting portion according to a second embodiment of the invention, wherein FIG. 6A is a transverse cross sectional view and FIG. 6B is an enlarged view of a noise absorption/heat insulating material.

DESCRIPTION OF THE PREFERRED EMBODIMENTS

A structure of an exhaust manifold branch collecting portion according to the invention will be described in detail with reference to the accompanying drawings.

Figure 1:
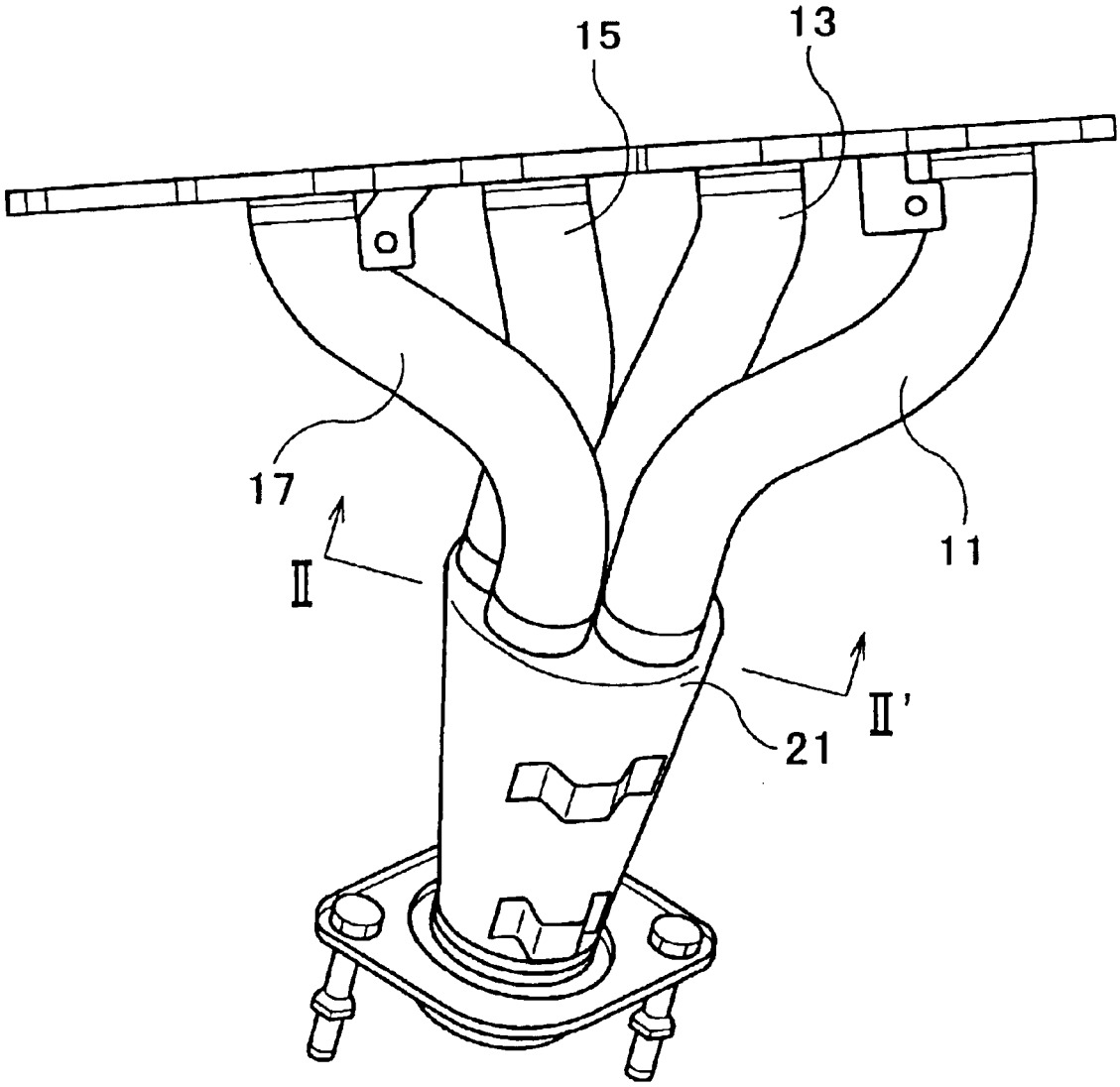
FIG. 1 is a perspective view of a structure of an exhaust manifold branch collecting portion according to a first embodiment of the invention.
Figure 2:
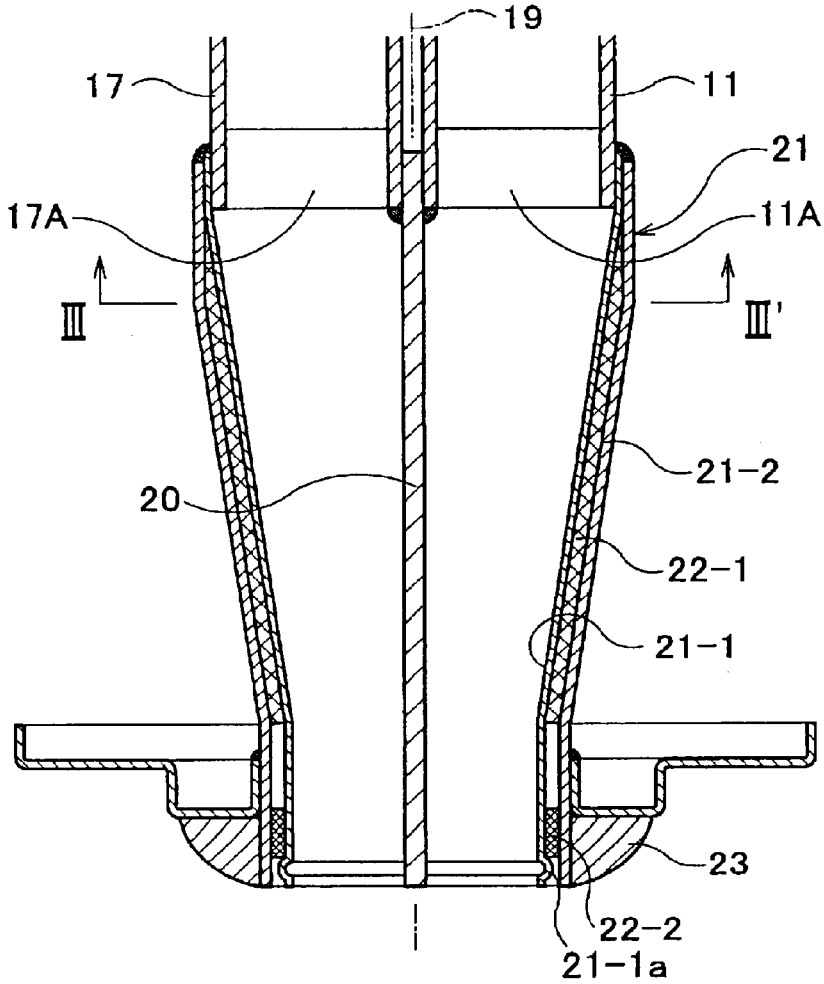
FIG. 2 is a sectional view taken along the line II–II' of FIG. 1.
Figure 3:
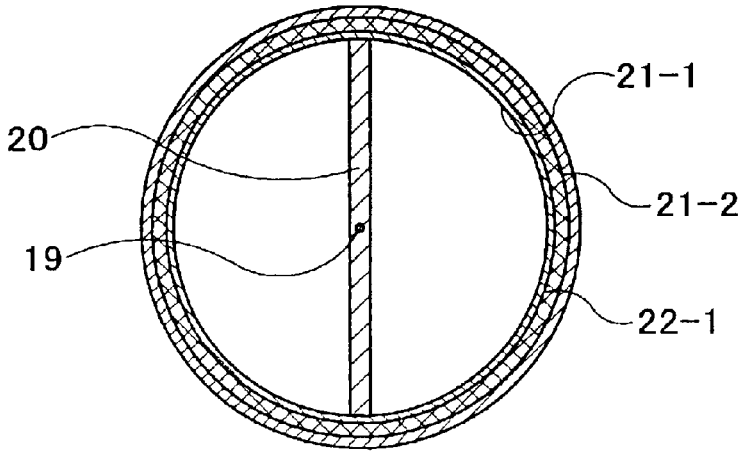
FIG. 3 is a sectional view taken along the line III–III' of FIG. 2.
Figure 4:
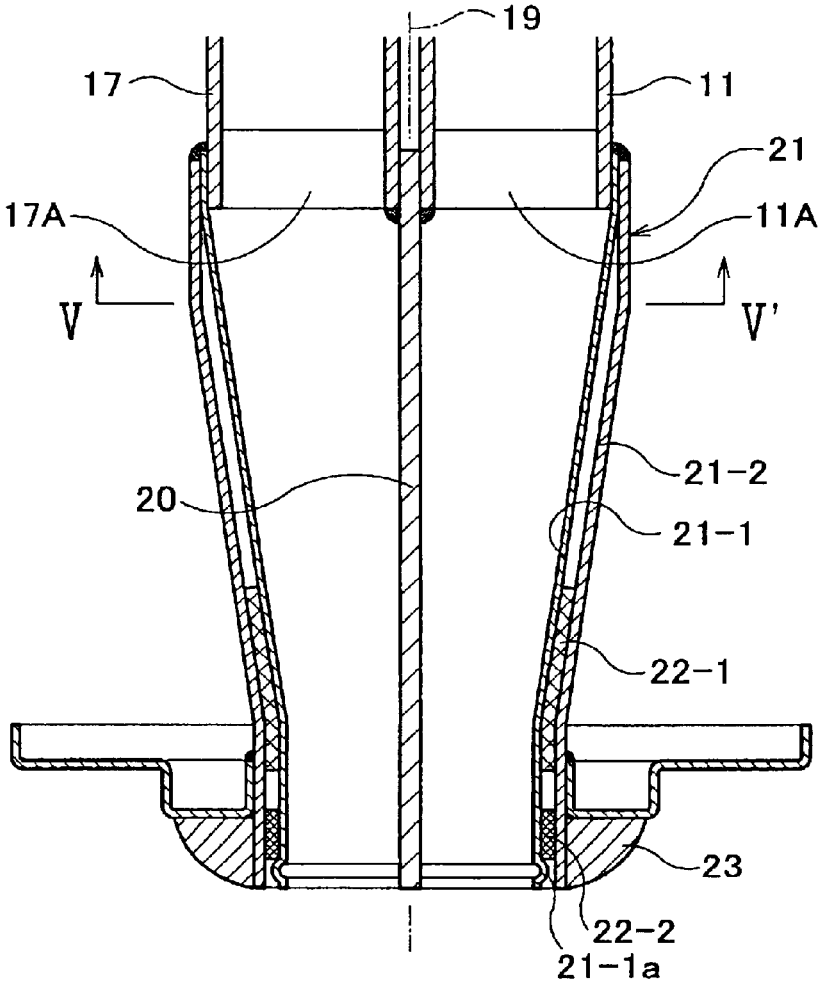
FIG. 4 is a sectional view illustrating a modified embodiment of the structure of the exhaust manifold branch collecting portion shown in FIG. 2.
Figure 5:
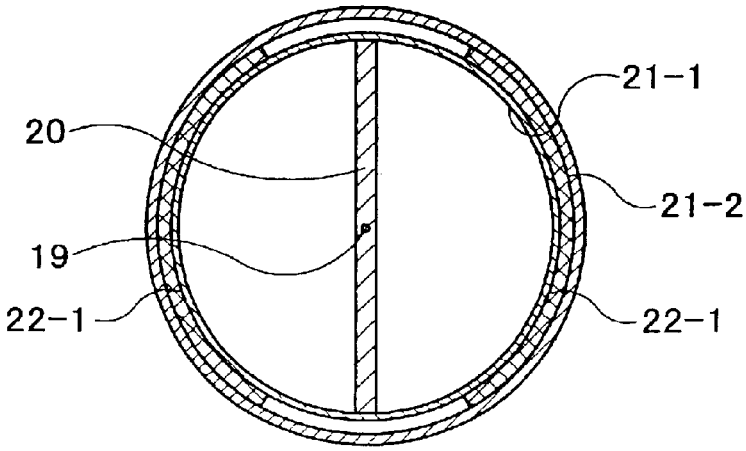
FIG. 5 is a sectional view taken along the line V–V' of FIG. 4.

As shown in FIGS. 1 through 3, an exhaust manifold branch collecting portion according to a first embodiment of the invention includes a double collecting pipe 21, which accommodates downstream outlet ends (exhaust openings) of a plurality of (four) exhaust pipe members 11, 13, 15, and 17 with a partition wall 20 positioned therebetween. The double collecting pipe 21 is constructed such that an inner pipe 21-1 and an outer pipe 21-2, which are arranged concentrically around the center line 19, are integrally connected to each other. The double collecting pipe 21 collects the exhaust openings of the exhaust pipe members 11, 13, 15, and 17 at its upstream portion and extends in a manner tapered or converged in the downstream direction. The upper ends of the inner pipe 21-1 and the outer pipe 21-2 are connected to each other, while the lower ends of the inner pipe 21-1 and the outer pipe 21-2 are connected through a cushion member 22-2 made of stainless steel.

Provided in an air layer formed between the inner pipe 21-1, the outer pipe 21-2, and the ring-shaped stainless steel cushion member 22-2 is a noise absorption/heat insulating material 22-1 substantially in the shape of a tube. The tubular-shaped noise absorption/heat insulating material 22-1 is a thermally expansible fire-resistant sheet with high temperature expansion characteristic (for example, Vermoflex (trade mark)), which is durable and is a mixture of inorganic material to be thermally expanded, ceramic fiber, and a small amount of inorganic-organic hybrid material. The noise absorption/heat insulating material 22-1 is foamed and expanded about four times in the direction of the thickness of the sheet when heated at about 400 to 540° C.

As shown in FIGS, 4 and 5, instead of mounting the noise absorption/heat insulating material 22-1 in the whole area between the inner pipe 21-1 and the outer pipe 21-2, the noise absorption/heat insulating material 22-1 may be mounted partly at an area where heat of exhaust gas is concentrated or vibratory noise is generated. Such an arrangement leads to reduction of the production cost.

The ring-shaped stainless steel cushion member 22-2 is fitted so as to position the noise absorption/heat insulating material 22-1 between the inner pipe 21-1 and the outer pipe 21-2, so that the relative expanded deviation of the inner and outer pipes 21-1 and 21-2 due to generated heat is absorbed. The stainless steel cushion member 22-2 is an elastic mesh member, which is made by press stamping lace stitched stainless steel wires into a ring shape. The upper ends (one ends) of the inner pipe 21-1 and the outer pipe 21-2 of the exhaust manifold branch collecting portion are connected to each other. Meanwhile, a projection 21-1*a* is provided at the lower end (the other end) of the inner pipe 21-1, so as to prevent the stainless steel cushion member 22-2 being fallen during the transfer. Instead of inserting the stainless steel cushion member 22-2, the lower end of the inner pipe 21-1 may be projected outwardly in the radial direction to form a cushion part. At the other end of the exhaust manifold branch collecting portion, a seal ring 23 is provided around the outer periphery, so that a non-illustrated exhaust pipe is connected thereto in the downstream direction.

The production method of the exhaust manifold branch collecting portion according to the invention will be described below. The noise absorption/heat insulating material 22-1 and the ring-shaped stainless steel cushion member 22-2 are mounted on the inner pipe 21-1 of the double collecting pipe 21, thereafter the outer pipe 21-2 is fixed to the inner pipe 21-1 at its upper end to form an integral structure. When the engine is started after the assembly of the exhaust manifold is completed, the noise absorption/heat insulating material 22-1 is heated by heat of the exhaust gas from the engine and expands, so that a restricted cushion structure consisting of the sealed noise absorption/heat insulating material 22-1 substantially in the shape of a tube is formed in a space surrounded by the inner pipe 21-1, the outer pipe 21-2, and the ring-shaped stainless steel cushion member 22-2.

The previously described structure of the exhaust manifold branch collecting portion achieves the following advantages. That is, because of the simple structure wherein the noise absorption/heat insulating material 22-1 is inserted between the inner pipe 21-1 and the outer pipe 21-2 of the double collecting pipe 21 at the time of production, unlike the conventional method, it is not necessary to remove spatters. This is because the thermally expanded noise absorption/heat insulating material surrounds spatters. Therefore, it is possible to provide a structure of an exhaust manifold branch collecting portion, which prevents occurrence of unusual noise derived from vibrations and which simplifies the production, thereby leading to reduction of the production cost.

Further, with the provision of the cushion part or the cushion member, the following advantages are achieved:

(1) A desired space can be obtained between the outer pipe 21-2 and the inner pipe 21-1 without deviation of the inner pipe 21-1 (because of the volume expansion of the noise absorption/heat insulating material); and (2) With the provision of the stainless steel cushion member 22-2 at the lower end (the other end) of the double collecting pipe 21, it is possible to prevent the noise absorption/heat insulating material being fallen as fine small pieces. Further, it is possible to absorb a distortion, deviation and occurrence of unusual sound, which are derived from the difference of expansion/contraction along the axial direction and the radial direction due to the difference of the thermal expansion.

Figure 6A:
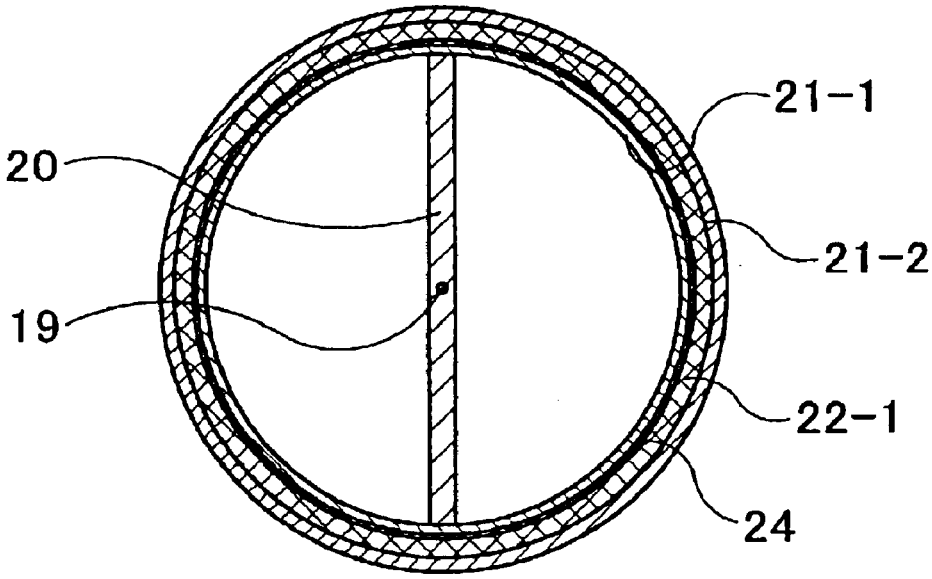
Figure 6B:
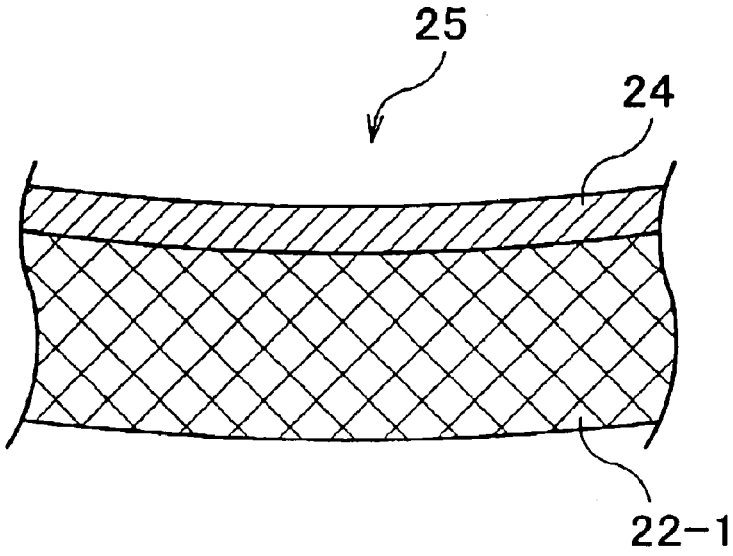

With reference to FIGS. 6A and 6B, an exhaust manifold branch collecting portion according to a second embodiment of the invention will be described below. Parts similar to those previously described in connection with the first embodiment are denoted by the same reference numerals, and detailed description thereof will be omitted.

As shown in the drawings, the exhaust manifold branch collecting portion of the second embodiment is substantially the same as that of the first embodiment, except that a heat resisting layer 24 is arranged between the inner pipe 21-1 and the noise absorption/heat insulating material 22-1.

The heat resisting layer 24 may be formed by spraying a heat resisting member, during the assembly of the exhaust manifold, on the inner pipe 21-1 at the side of the noise absorption/heat insulating material 22-1. Alternatively, as shown in FIG. 6B, a heat resisting member may be mounted on either one side or both sides of the noise absorption/heat insulating material 22-1, and the thus formed heat resistible noise absorption/heat insulating material 25 with two or three layered structure is mounted on the inner pipe 21-1, followed by assembly of the outer pipe 21-2.

Similar to the exhaust manifold branch collecting portion according to the first embodiment, the noise absorption/heat insulating material 22-1 and the heat resisting layer 24 may be mounted partly at an area where heat of exhaust gas is concentrated or vibratory noise is generated.

With the provision of the heat resisting layer 24 between the inner pipe 21-1 and the noise absorption/heat insulating material 22-1, in addition to the advantages of the exhaust manifold branch collecting portion according to the first embodiment, the durability of the noise absorption/heat insulating material 22-1 can be improved further.

While the present invention has been described in detail with reference to specific embodiments thereof, it will be apparent to one skilled in the art that various changes and modifications may be made without departing from the scope of the claims. For example, instead of the double collecting pipe 21, a triple or more collecting pipe may be employed with the use of a double or more noise absorption/heat insulating material.

Although the collecting pipe 21 is shown as a double collecting pipe, the present invention may be adopted for the respective exhaust pipe members 11, 13, 15, and 17. In this instance, double exhaust pipe members each including an inner pipe and an outer pipe are assembled integrally such that a restricted cushion structure consisting of a noise absorption/heat insulating material between the inner pipe and the outer pipe is formed for the respective exhaust pipe members 11, 13, 15, and 17.

What is claimed is:

1. A structure of an exhaust manifold branch collecting portion including a collecting pipe for collecting a plurality of exhaust openings, wherein the collecting pipe is constructed as a double collecting pipe arrangement comprised of an inner pipe and an outer pipe, and wherein a noise absorption/heat insulating material to be expanded by heating is arranged between the inner pipe and the outer pipe, wherein the noise absorption/heat insulating material remains expanded when cooled after being once heated.

2. A structure of an exhaust manifold branch collecting portion according to claim 1, wherein the noise absorption/heat insulating material is heated and expanded by heat of exhaust gas from an engine.

3. A structure of an exhaust manifold branch collecting portion according to claim 1, wherein one ends of the inner pipe and the outer pipe are connected to each other, and a cushion part is arranged between the other ends of the inner pipe and the outer pipe.

4. A structure of an exhaust manifold branch collecting portion according to claim 2, wherein one ends of the inner pipe and the outer pipe are connected to each other, and a cushion part is arranged between the other ends of the inner pipe and the outer pipe.

5. A structure of an exhaust manifold branch collecting portion according to claim 3, wherein the cushion part is an elastic mesh member, into which a stainless steel wire is woven.

6. A structure of an exhaust manifold branch collecting portion according to claim 4, wherein the cushion part is an elastic mesh member, into which a stainless steel wire is woven.

7. A structure of an exhaust manifold branch collecting portion according to claim 1, wherein a heat resisting layer is arranged between the inner pipe and/or the outer pipe and the noise absorption/heat insulating material.

8. A structure of an exhaust manifold branch collecting portion according to claim 2, wherein a heat resisting layer is arranged between the inner pipe and/or the outer pipe and the noise absorption/heat insulating material.

9. A structure of an exhaust manifold branch collecting portion according to claim 3, wherein a heat resisting layer is arranged between the inner pipe and/or the outer pipe and the noise absorption/heat insulating material.

10. A structure of an exhaust manifold branch collecting portion according to claim 4, wherein a heat resisting layer is arranged between the inner pipe and/or the outer pipe and the noise absorption/heat insulating material.

11. A structure of an exhaust manifold branch collecting portion according to claim 5, wherein a heat resisting layer is arranged between the inner pipe and/or the outer pipe and the noise absorption/heat insulating material.

12. A structure of an exhaust manifold branch collecting portion according to claim 6, wherein a heat resisting layer is arranged between the inner pipe and/or the outer pipe and the noise absorption/heat insulating material.

13. A structure of an exhaust manifold branch collecting portion according to claim 1, wherein the expansion ratio is 4.0 or more after heating for 30 minutes at 850° C.

* * * * *